US005921486A

United States Patent [19]

Matthew

[11] Patent Number: 5,921,486

[45] Date of Patent: Jul. 13, 1999

[54] PAPERMAKING REFINER PLATES

[75] Inventor: John B Matthew, Norwalk, Conn.

[73] Assignee: Norwalk Industrial Components, LLC, Norwalk, Conn.

[21] Appl. No.: 09/016,984

[22] Filed: Feb. 2, 1998

Related U.S. Application Data

[62] Division of application No. 08/632,215, Apr. 15, 1996, Pat. No. 5,740,972.

[51] Int. Cl.[6] ..... B02C 7/12

[52] U.S. Cl. ..... 241/298

[58] Field of Search ..... 241/296, 298, 241/261.2, 261.3

[56] References Cited

U.S. PATENT DOCUMENTS 3,459,379 8/1969 Brown .

FOREIGN PATENT DOCUMENTS 1895 1/1912 United Kingdom ..... 241/298

*Primary Examiner*—Mark Rosenbaum
*Attorney, Agent, or Firm*—Patrick J. Walsh

[57] ABSTRACT

Replacable refiner plates used for papermaking and refining of lignocellulosic and other natural and synthetic fibrous materials in the manufacture of paper, paperboard, and fiberboard products. The refiner plates include blade patterns and use corrosion resistant materials.

6 Claims, 2 Drawing Sheets

PAPERMAKING REFINER PLATES

This is a division of application Ser. No. 632,215 filed Apr. 15, 1996, now U.S. Pat. No. 5,740,972.

BACKGROUND OF THE INVENTION

The present invention relates to papermaking and refining of lignocellulosic and other natural and synthetic fibrous materials in the manufacture of paper, paperboard, and fiberboard products. In particular, the invention relates to replacable refiner fillings used in the process of refining chip or pulp.

In nearly all production refining equipment in use today including beaters, jordans, conical refiners, multi-disc, and disc refiners, the refining working surfaces of the refiner fillings are comprised of closely spaced bars and grooves which work against each other through relative rotation while the fibrous material passes between them. The clearance between the opposed bar and groove working surfaces determines the power applied to the refiner, as well as the extent of refining of the fibrous material.

In each kind of refiner equipment, it is often desirable to make bars as narrow and as closely spaced from each other as possible in order to achieve maximum bar edge length for the refiner with resultant distribution of the refiner power over a greater number of bar contact or bar crossing points. This relative intensity, or specific edge load as it is called, is widely recognized as an important quality parameter for most paper and board products.

While the bars of any refiner type can be of any practical width and spacing, the actual width and spacing are limited by the materials and methods used to make them, or by the cost to make them, or both. In a typical disc refiner, the replacable working surfaces, or refiner plates as they are most commonly called, may be made by casting or machining. In some instances they may be made by fabricating wherein appropriately spaced bars are affixed by welding onto a base.

In the case of cast refiner plates, the width of the bar and the width of the groove are limited to no less than about ⅛". At normal groove depths of ¼" or so, cast bars narrower than this are prone to breakage due to internal flaws, and the need to have a draft angle of 3 deg. or so for the casting process, causes the groove volume (which provides for passage of fibrous material) to be greatly diminished at closer bar spacing than about ⅛".

In the case of machined refiner plates, the limiting factor is cost. The cost is more or less proportional to the number of grooves which must be milled to the required depth in a solid steel blank.

In the case of fabricated plates, cost is also a constraint because bars are individually welded.

Another important feature of replacement refiner plates is their useful life. During operation, the bars become worn down, until at some point, the depth of the groove between bars is so shallow that the refiner can no longer adequately transport fibrous material through the refiner plates. There are several causes of wear including abrasive nature of the fibrous materials and other particles in the medium, and the clashing of the refiner plates in the event of sudden interruption of the flow of process material.

The precise nature of the wearing of refiner plates is not fully understood. Hardness of the bar material has been shown to be an important factor. It has also been demonstrated that the rate of wear is very closely related to the corrosion resistance of the bar material.

In general, a compromise must be reached between the hardness, corrosion resistance, and toughness of the material that is chosen for a cast or machined refiner plate. Toughness is a required property because occasional tramp metal contamination occurs in the process medium. If the plates were to shatter when a piece of metal passed through the refiner, it would cause severe and costly operational problems for the paper or board mill.

There are several potential wear advantages to fabricated or machined refiner plates, however a serious limitation results from the necessity of producing refiner discs in a complete circle configuration. A full circle replacement plate for a 34" or larger refiner will weigh several hundred pounds thus requiring lifting aids for installation into, and removal from, a refiner. Cast refiner plates can be, and usually are produced in segments, with each segment being 30, 45, or 60 degrees and with 12, 8, or 6 segments respectively being required to make up a complete replacement working surface for a single disc of a disc refiner. Each segment will weigh less than 35 pounds, and will usually be individually bolted into the place on the disc, such that an entire set of plates can be replaced by a person without the need for special lifting devices. For this and other reasons, most replacement disc refiner plates are castings, usually of special cast iron or stainless steel alloys.

As a practical matter, one of the reasons machined or fabricated plates are not produced as segments has to do with an operational requirement for non-parallel edge crossing of the refiner bars for processing fibrous material. If a stator plate and a rotor plate, whose working surfaces act against each other, contain bars whose leading edges pass each other in parallel or nearly parallel condition, there is a known tendency for excessive cutting of the fibrous material being processed. Thus it is often a process requirement that a refiner plate does not have any precisely radial bars, but rather that it have bars with at least a slight offset or oblique from a radial orientation, typically between 3 and 20 degrees.

Refiner disc plate segments have precisely radial side edges such that it is a somewhat costly complication to produce a disc working surface pattern having no precisely radial bar or groove at the segmental dividing lines. Therefore, the segment joint must cut across the pattern of bars and grooves at a shallow angle. This requirement is difficult and costly to accomplish in the case of machined and fabricated plates and which, even in the case of cast plates, leaves narrowly tapered bars likely to be very much weakened at their extremities.

In sum, the utility of disc refiner plates is limited by the operational requirement for bars oriented obliquely to radial, by consequent manufacturing limitations, and by the rate of working surface wear through corrosion and abrasion.

SUMMARY OF THE INVENTION

The present invention provides improvements in replaceable refiner fillings and has as a primary objective the manufacture of refiner fillings with working surfaces using relatively narrow, closely spaced bars on the working surface of the plate. This is accomplished by using relatively thin blades of any suitable material, separated by shallower spacer bars having a thickness which determines the width of the grooves, and subsequently fusing or bonding the assembled blades and spacers into a solid piece by methods appropriate for the blade and spacer materials being used.

In another primary aspect of the invention, blade and spacer components are selected from metallic materials having different corrosion resistance. Cathodic protection for the refiner blade elements is achieved by using a metallic material for the spacer which is less noble, according to the Electromotive-Force Series of Metals, than the material used for the blade. In this way, the spacer, which is not subject to appreciable abrasion, will pit and corrode harmlessly, while the blade or bar wear is greatly reduced. This feature of galvanic, or cathodic, protection is also applied to cast or machined refiner plates by inserting or attaching sacrificial metal elements.

In a further primary objective of the invention, improved segmental replacement disc refiner plates are produced with segments having both non-circular edges (i.e., side edges) which are not precisely radial. Instead, the side edges are oblique to the precisely radial line by an angle between about 3 and 20 degrees such that the refiner plate segmental dividing line is parallel to the adjacent refiner blade.

OBJECTS OF THE INVENTION

It is an object of the invention to provide improved refiner plates for use in papermaking refiners.

It is an object of the invention to provide improved refiner plates in which bars and spacers are assembled in proper order and are fused or bonded together.

It is a further object of the invention to provide improved refiner plates in which bars and spacers are selected for corrosion resistance.

It is a further object of the invention to provide improved refiner plates in which bars and spacers are selected from the Electromotive-Force Series of Metals with the spacers being a metal less noble than the metal selected for the bars.

It is a further object of the invention to provide improved refiner disc plate segments of a circle having side edges oblique to the radius of the circle and with at least a portion of the bars parallel to an oblique side edge.

It is a further object of the invention to provide improved refiner disc plate segments having side edges oblique to a radius of the disc with the bar pattern parallel to an oblique side edge and with the bar pattern repeating as necessary to have all bars on the working surface of the disc plate within a given range of obliquity to the radius.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention and is shown in the accompanying drawing in which.

DETAILED DESCRIPTION OF THE INVENTION

Figure 1:
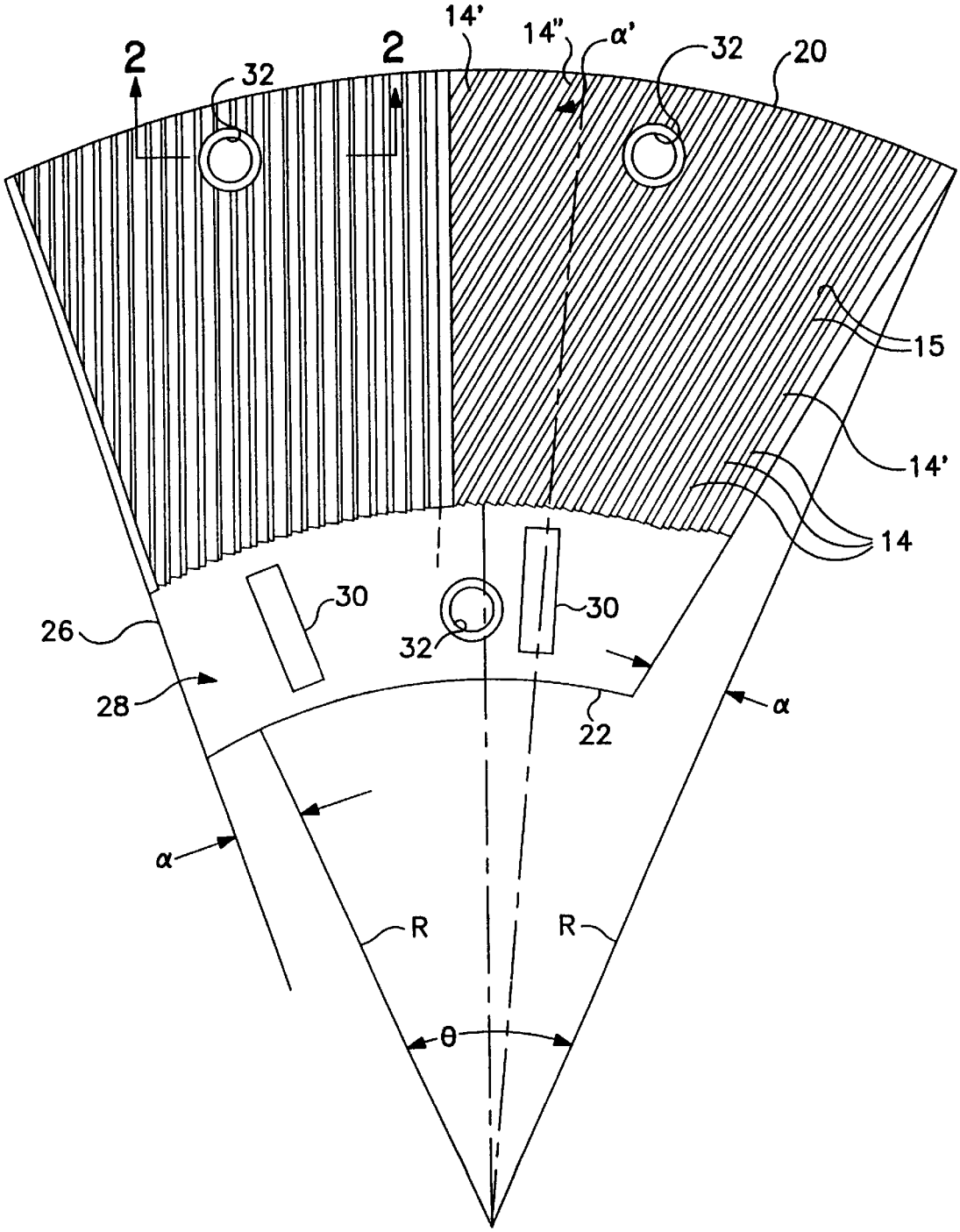
FIG. 1 is a plan view of the working surface of a refiner disc plate showing an arrangement of bars according to the invention.
Figure 2:
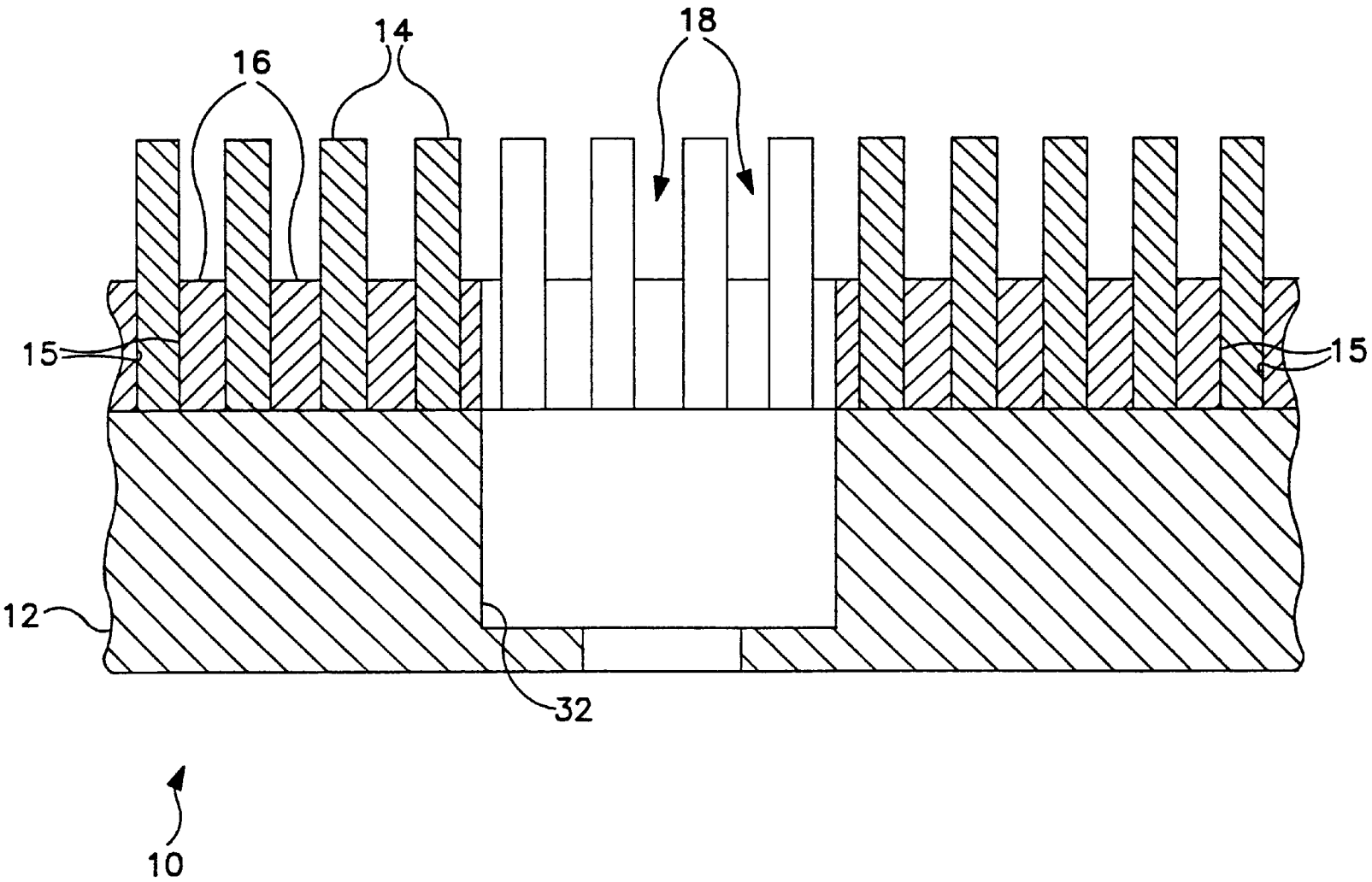
FIG. 2 is a section view taken along FIG. 2—2 of FIG. 1.

Referring to the drawing, a preferred embodiment of a refiner disc 10 according to the invention comprises a supporting plate 12 to which blades 14 and spacers 16 are affixed and wherein the blades and spacers define the disc working surface and intervening grooves 18.

The blades may be fabricated of any suitable durable material including metals such as aluminum, bronze, nickel alloy, and ceramic or composite materials capable of bonding to spacers. Similarly, the spacers are any suitable material that can be strongly bonded to the supporting plate. Materials for blades are selected for hardness and corrosion resistance.

In a preferred embodiment of the invention, the blades are fabricated of stainless steel, and the spacers of plain carbon steel, and the backing plate of either plain carbon steel or stainless steel. The entire assembly of blades, spacers and backing plate are bonded to comprise a refiner disc by a process of copper brazing or high temperature diffusion welding.

During use, the topmost surface of the stainless steel blade is constantly exposed to abrasive removal of a protective oxide layer. The exposed surface is much more resistant to abrasive/corrosive wear because of the cathodic protection provided by the immediately adjacent and less noble carbon steel spacer.

As shown in FIG. 1, a preferred embodiment of the invention, the refiner disc 10 is defined by outer 20 and inner 22 concentric segments and side edges 24, 26 offset or oblique to the radius R of the outer circle.

Each segment may have a value for θ of 30, 45, or 60 degrees so that 12, 8, or 6 segments, respectively comprise a refiner disc.

The extent of offset of the side edges is indicated by the angle which is preferably between 3 and 20 degrees off the radial. Beginning at the right side edge 24 in FIG. 1, the segement bars 14 are positioned parallel to the right side edge and extend from the outer periphery 20 inwardly toward the inner periphery 22 of the segment. As shown in FIG. 1, the bars terminate short of the inner periphery thereby defining with the inner periphery a feeding zone 28 for pulp entry to the refiner blades and grooves. Feeder bars 30 aid in directing pulp flow into the refeiner grooves. Bores 32 accommodate fasteners (not shown) for securing the segments in place.

It will be apparent from FIG. 1 that blade obliqueness to the segment radial R increases with distance normal to right side edge 24. For example, the blade 14' nearest the right side edge has an oblique angle equal to , while bar 14" has a greater oblique angle, . It is desirable with refiner plates to avoid shallow crossing angles (i.e., high degree of obliquity to radial) of stator and rotor blades and therefore desirable to maintain blade obliqueness in a range of 3 to 20 degrees. Hence, the blade pattern is begun anew at that location in the refiner segment where increasing obliqueness (as the case with blade 14") approaches 20 degrees. So, at this location the bar pattern is reset beginning with a low angle , say 3 degrees, and continuing until the bar pattern reaches the left side edge of the segment 26.

Blade pattern repetition may be unnecessary in the case of narrower disc segments as in a refiner disc with 12 segments of 30 degrees each.

It will be seen that the disc refiner segment with non-radial side edges permits the blade of spacer immediately adjacent to one edge to be parallel to the edge while not being precisely radial in its orientation. Therefore, the bars on opposing rotor and stator plates never cross radially and thereby avoid refiner process disadvantages induced by radial crossing of bars. At the same time, the refiner plates according to the invention have the advantages of reduced cost and increased durability with having short blades bordering on one edge only of the disc segment.

Various changes may be made to the structure embodying the principles of the invention. The principles of the invention, while described in preferred embodiment of refiner disc segments, are also applicable to other configurations of refiner fillings. For example, the invention also has application to working surfaces of refiners in conical configurations.

The foregoing embodiments are set forth in an illustrative and not in a limiting sense. The scope of the invention is defined by the claims appended hereto.

I claim:

1. A segment for a refiner disc for refining a material including pulp and paper, the refiner disc having a radius, the segment comprising a supporting plate in the form of an integral segment of a circle, the supporting plate defined by an outer periphery, an inner periphery, and first and second side edges extending between the outer an(I inner peripheries, the first side edge being oblique to the refiner disc radius, the supporting plate having blades and spacers affixed thereto to define a working surface, the blades and spacers positioned alternately on the supporting plate to form grooves between adjacent blades, each blade having a topmast surface for refining material, and the grooves providing channels for flow of material to the blades, the blades and spacers aligned parallel to the oblique side edge within a range of obliqueness of 30° to 20° with respect to the disc radius, the blades and spacers bonded to each other and to the supporting plate thereby forming a unitary segment, and means for securing the unitary segment to a refiner disc.

2. A segment as defined in claim 1 in which the segment is 30 degrees of a circle.

3. A segment as defined in claim 1 in which the segment is 45 degrees of a circle.

4. A segment as defined in claim 1 in which the segment is 60 degrees of a circle.

5. A replaceable segment for a refiner filling for refining a material including pulp and paper, the refiner filling having a radius, the segment comprising a supporting plate in the form of a segment of a circle, the supporting plate defined by an outer periphery, an inner periphery, and first and second side edges extending between the outer and inner peripheries, the first side edge being oblique to the refiner filling radius, the supporting plate having an integral working surface of bars and grooves, each bar having a topmost surface for refining material, the grooves providing channels for flow of material to the bars, the bars and grooves aligned parallel to the oblique side edge within a range of obliqueness of 30° to 20° with respect to the filling radius, and means for securing the segment to a refiner filling.

6. A segment according to claim 5 having a plurality of patterns of bars and grooves within said range of obliqueness.

* * * * *

UNITED STATES PATENT AND TRADEMARK OFFICE

CERTIFICATE OF CORRECTION

PATENT NO. : 5,921,486

DATED : July 13, 1999

INVENTOR(S) : John B. Matthew

It is certified that error appears in the above-identified patent and that said Letters Patent is hereby corrected as shown below:

Column 5, line 21, "topmast" should read --topmost--.
line 24, "$30^0$" should read --$3^0$--.

Column 6, line 21, "$30^0$" should read --$3^0$--

Signed and Sealed this

Eighth Day of August, 2000

*Attest:*

Q. TODD DICKINSON

*Attesting Officer*

*Director of Patents and Trademarks*